US011111874B2

(12) United States Patent
Behr et al.

(10) Patent No.: US 11,111,874 B2
(45) Date of Patent: Sep. 7, 2021

(54) CYLINDER HOUSING FOR A RECIPROCATING-PISTON INTERNAL COMBUSTION ENGINE

(71) Applicant: Daimler AG, Stuttgart (DE)

(72) Inventors: Thomas Behr, Elchingen (DE); Klaus Geiger, Kuchen (DE); Udo Grimmer, Ulm (DE); Tobias Hanschke, Westerstetten (DE); Martin Hartweg, Erbach (DE); Volker Lagemann, Ulm (DE); Harald Scheib, Blaustein (DE); Sebastian Schiefer, Ulm (DE); Martin Stroeer, Immenstaad (DE); Silvia Tomaschko, Ulm (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/349,880

(22) PCT Filed: Oct. 6, 2017

(86) PCT No.: PCT/EP2017/001181

§ 371 (c)(1),
(2) Date: May 14, 2019

(87) PCT Pub. No.: WO2018/091120

PCT Pub. Date: May 24, 2018

(65) Prior Publication Data

US 2019/0271281 A1 Sep. 5, 2019

(30) Foreign Application Priority Data

Nov. 15, 2016 (DE) ..... 10 2016 013 602.2

(51) Int. Cl.
*F02F 1/00* (2006.01)
*F02F 1/18* (2006.01)

(52) U.S. Cl.
CPC ..... *F02F 1/004* (2013.01); *F02F 1/18* (2013.01)

(58) Field of Classification Search
CPC ..... F02F 1/004; F01F 1/18
USPC ..... 123/193.2
See application file for complete search history.

(56) References Cited

U.S. PATENT DOCUMENTS 5,086,734 A 2/1992 Nakai

FOREIGN PATENT DOCUMENTS

| | | | |
|---|---|---|---|
| CN | 1179741 | A | 4/1998 |
| DE | 10 2008 026 146 | A1 | 12/2009 |
| DE | 10 2009 024 227 | A1 | 1/2010 |
| DE | 10 2011 117 660 | A1 | 5/2013 |

(Continued)

OTHER PUBLICATIONS

PCT/EP2017/001181, International Search Report dated Jan. 11, 2018 (Two (2) pages).

(Continued)

*Primary Examiner* — Hung Q Nguyen
*Assistant Examiner* — Anthony Donald Taylor, Jr.
(74) *Attorney, Agent, or Firm* — Crowell & Moring LLP

(57) ABSTRACT

A cylinder housing for a reciprocating-piston internal combustion engine, in particular of a motor vehicle, includes a first cylinder which is delimited by a first cylinder barrel and a second cylinder which is delimited by a second cylinder barrel. The cylinders differ from one another with respect to their respective inner contour formed by the respective cylinder barrels.

1 Claim, 3 Drawing Sheets

(56) References Cited

FOREIGN PATENT DOCUMENTS

| | | | | | |
|---|---|---|---|---|---|
| GB | 2504618 | | * | 2/2014 | ..... B23B 41/12 |
| GB | 2504618 | A | | 2/2014 | |
| JP | 57-126539 | A | | 8/1982 | |
| JP | S57126539 | A | * | 8/1982 | ..... F02F 1/00 |
| JP | 60-149854 | U | | 10/1985 | |
| JP | S60149854 | U | * | 10/1985 | ..... F02B 75/20 |
| JP | 6-126613 | A | | 5/1994 | |
| JP | 2002-195095 | A | | 7/2002 | |
| JP | 2002195095 | | * | 7/2002 | ..... B22D 19/08 |
| JP | 2010-76032 | A | | 4/2010 | |
| JP | 2013-46946 | A | | 3/2013 | |
| JP | 2013046946 | A | * | 3/2013 | ..... B24B 33/02 |
| WO | WO 96/30159 | A1 | | 10/1996 | |

OTHER PUBLICATIONS

Japanese Office Action issued in Japanese application No. 2019-519214 dated Jan. 21, 2020, with partial English translation (Nine (9) pages).

Japanese Office Action issued in Japanese application No. 2019-519214 dated Jul. 21, 2020, with partial English translation (Six (6) pages).

Chinese Office Action issued in Chinese application No. 201780068409.9 dated Aug. 28, 2020, with partial English translation (Eight (8) pages).

Machine English translation of JP S57-126539 A, which was previously submitted as B6 on Apr. 22, 2020 (Four (4) pages).

* cited by examiner

CYLINDER HOUSING FOR A RECIPROCATING-PISTON INTERNAL COMBUSTION ENGINE

BACKGROUND AND SUMMARY OF THE INVENTION

The invention relates to a cylinder housing for a reciprocating internal combustion engine.

Cylinder housings of this kind for reciprocating internal combustion engines, in particular of motor vehicles, are already well known from the general prior art and in particular from series construction of motor vehicles. The cylinder housing comprises a first cylinder delimited by a first cylinder barrel and at least one second cylinder delimited by a second cylinder barrel. The cylinders are combustion chambers in which combustion processes take place during fired operation of the reciprocating internal combustion engine. Usually, a piston is received in each of the cylinders so as to be translationally movable, the pistons being driven by the combustion processes.

Furthermore, DE 10 2008 026 146 A1 discloses a cylinder of an internal combustion engine, in which the cylinder comprises a cylinder running surface which has a top piston reversal region and a bottom piston reversal region for a piston. In particular, the piston can be supported in the radial direction thereof against the cylinder barrel, which is also referred to as the cylinder running surface or liner, it being possible, for example, for the piston to at least temporarily run or slide along the cylinder barrel as it travels from its bottom dead center to its top dead center, and vice versa.

DE 10 2009 024 227 A1 discloses a cylinder crankcase comprising a cylinder bore which is delimited by a cylinder barrel. In the document, the cylinder bore does not extend cylindrically.

Furthermore, DE 10 2011 117 660 A1 discloses an internal combustion engine comprising at least one cylinder, in the cylinder chamber of which a piston is arranged which is axially movable between a top reversal point and a bottom reversal point and comprises at least one piston ring.

The object of the present invention is to develop a cylinder housing of the type mentioned at the outset such that it is possible for the reciprocating internal combustion engine to be operated in a particularly efficient manner and to have particularly advantageous noise characteristics.

In order to develop a cylinder housing of the type specified herein such that it is possible for the reciprocating internal combustion engine to be operated in a particularly efficient manner and to have particularly advantageous noise characteristics, according to the invention, the cylinders are different from one another in terms of their respective internal contours formed by the respective cylinder barrels. Each internal contour preferably widens downwards in an axial direction of the relevant cylinder in a specific portion or length region. Therefore, the internal contour or the cylinder barrel is conical, for example, the widening being formed, for example, by trumpet honing, in particular by conical trumpet honing.

The invention is based, in particular, on the finding that, in a reciprocating internal combustion engine, the cylinders may be subject to cylinder-specific or cylinder-individual distortions, the distortions of the cylinders also being referred to as cylinder distortions. These cylinder-specific cylinder distortions may be caused, for example, by a cylinder head screw connection, by combustion chamber pressures prevailing in the cylinders, designed as combustion chambers, when the reciprocating internal combustion engine is in fired operation, and by thermal expansions of the cylinder housing and thus of the cylinder barrels. Cylinder-specific cylinder distortions should be understood to mean that the cylinders behave differently, or that each cylinder is subject to different distortions such that not all cylinders have the same thermal distortion. Therefore, if, for example, the cylinders have the same internal contour in a starting state and then different cylinder distortions occur during fired operation in particular, the cylinders have internal contours that are different from one another during fired operation, for example. This can result in increased friction power and/or in undesired noises being generated, since, for example, clearances between the cylinder barrels and the respective pistons received in the cylinders so as to be translationally movable are of unfavorable values. If, for example, this clearance, which is also referred to as piston clearance, is too high or if the clearance is of a value which is too high, undesirable noises may be generated owing to contact alterations for example, and this can negatively impact the noise characteristics of the reciprocating internal combustion engine. If, however, the clearance is too low or if the clearance is of a value which is too low, there is excess friction between each of the pistons and the relevant cylinder barrel, as a result of which the reciprocating internal combustion engine has excessively high friction power.

These problems and drawbacks can be avoided in the cylinder housing according to the invention, since the cylinder-specific cylinder distortions can be optimally compensated for or at least substantially compensated for by the internal contours that are different from one another and are each formed, for example, by cylinder-specific conical trumpet honing. As a result, excessively high values and excessively low values for the piston clearance can be avoided, such that the friction power and thus the fuel consumption and CO2 emissions of the reciprocating internal combustion engine can be kept low, and it is also possible for the reciprocating internal combustion engine to have particularly advantageous noise characteristics. The noise characteristics of the reciprocating internal combustion engine are also referred to as NVH (noise vibration harshness) characteristics.

The invention is also based on the finding that, in conventional reciprocating internal combustion engines, each cylinder usually has cylinder honing and therefore has an at least substantially cylindrical shape, i.e., the shape of a right circular cylinder. The construction of the cylinder housing designed, for example, as a crankcase or cylinder crankcase, the tapering of cylinder head screws, thermal expansions in fired operation and cylinder pressures prevailing in the cylinders during fired operation may result in the shape of the internal contour deviating significantly from the ideal cylindrical shape during fired operation, and this is associated with drawbacks relating to friction power and thus consumption. These problems and drawbacks can also be avoided. For example, at room temperature, each internal contour has a shape that is different from a cylindrical shape, and yet the shape of the internal contour is brought closer to the ideal cylindrical shape or at least substantially corresponds to the ideal cylindrical shape due to the cylinder housing being heated as a result of fired operation. This makes it possible to prevent undesired noises from being generated, it being possible to simultaneously keep the friction power and thus the fuel consumption and CO2 emissions of the reciprocating internal combustion engine low.

Each internal contour is produced, for example, by specific honing of the relevant cylinder barrel, which is also referred to as the cylinder running surface or liner, trumpet honing, in particular cylinder-specific trumpet honing, being used for the honing, for example.

Since the internal contours are different from one another, the cylinders or the internal contours have different diameters, i.e., cylinder diameters, at least in respective portions, as a result of which the piston clearance can be set at an optimum value. In particular, overlapping states between the piston and the cylinder barrel can thereby be prevented, such an overlapping state resulting in high friction power and thus high fuel consumption. In other words, cylinder-specific honing, in particular trumpet honing, and/or a cylinder-specific diameter for the cylinder barrels is provided, for example, such that the barrels are different from one another in terms of their honing, in particular in terms of their trumpet honing, and/or in terms of their diameter. As a result, each cylinder barrel can be designed as a cylinder barrel which is optimized with regard to NVH and friction power, in particular by taking into account the specific contact alteration of the piston, and therefore advantageous piston clearance can be achieved.

Other advantages, features and details of the invention will become apparent from the following description of preferred embodiments and with reference to the drawings. The features and feature combinations mentioned above in the description and the features and feature combinations mentioned below in the description of the figures and/or shown in the figures alone can be used not only in the combination specified in each case, but also in other combinations or in isolation, without departing from the scope of the invention.

DETAILED DESCRIPTION OF THE DRAWINGS

Figure 1:
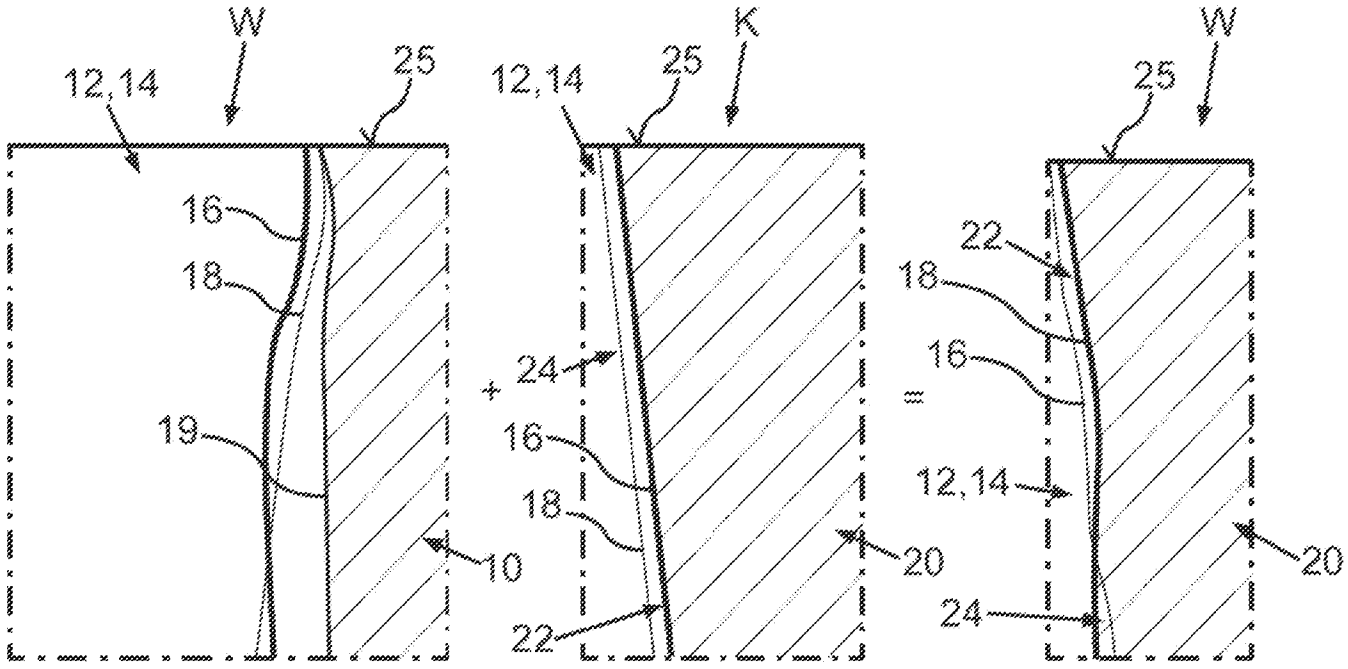
FIG. 1 shows details of a schematic side view of a cylinder housing according to a first embodiment for a reciprocating internal combustion engine, the cylinder housing comprising cylinders which are different from one another in terms of their respective internal contours formed by their respective cylinder barrels.

In the drawings, the same or functionally identical elements are provided with the same reference signs.

FIG. 1 shows details of a schematic side view of a cylinder housing, denoted as a whole by reference sign 10, for a reciprocating internal combustion engine of a motor vehicle, which can be driven by means of the reciprocating internal combustion engine. The reciprocating internal combustion engine comprises, when produced in its entirety, a drive shaft designed as a crankshaft that can rotate about a rotational axis relative to the cylinder housing 10. The crankshaft is mounted, for example, on a crankcase of the reciprocating internal combustion engine so as to be rotatable about a rotational axis relative to the crankcase. The crankcase can be formed in one piece with the cylinder housing 10 such that the cylinder housing 10 is designed as a cylinder crankcase. Alternatively, it is conceivable for the cylinder housing 10 and the crankcase to be formed as separate, interconnected components. The reciprocating internal combustion engine also comprises at least one cylinder head (not shown in the drawings) and is connected, in particular screwed, to the cylinder housing 10.

The cylinder housing 10 comprises a first cylinder 12 and a second cylinder 14 which are combustion chambers of the reciprocating internal combustion engine. In fired operation of the reciprocating internal combustion engine, the fired operation of which is also referred to as ignited operation, combustion processes take place in the cylinders 12 and 14. A piston (not shown in the drawings) is received in each of the cylinders 12 and 14 so as to be translationally movable, each piston being able to move between a bottom dead center (BDC) and a top dead center (TDC). The bottom dead center and the top dead center are dead centers or reversal points at each of which a movement direction of the piston is reversed. By definition, as it travels from the top dead center to the bottom dead center, the piston moves downwards and thereby away from the cylinder head, in particular away from a combustion chamber roof which is formed by the cylinder head and associated with the cylinder in question. As it travels from the bottom dead center to the top dead center, the piston moves upwards and thus towards the cylinder head or the combustion chamber roof.

The pistons are hingedly coupled to the crankshaft by means of respective connecting rods such that the translational movements of the pistons are converted into a rotational movement of the crankshaft about the rotational axis thereof. The pistons are driven by the respective combustion processes taking place in the respective cylinders 12 and 14. In the drawings, the cylinders 12 and 14 are shown together or such that they are mutually overlapping so that any similarities and differences between the cylinders 12 and 14 can be clearly illustrated.

It can be seen from FIG. 1 that the first cylinder 12 is delimited by a first cylinder barrel 16 and the second cylinder 14 is delimited by a second cylinder barrel 18, the respective cylinder barrels 16 and 18 also being referred to as cylinder running surfaces, piston barrels, piston running surfaces or liners. Each piston can be supported in the radial direction thereof against the relevant cylinder barrel 16 or 18 and slide along the relevant cylinder barrel 16 or 18, for example, as it travels from the top dead center to the bottom dead center, and vice versa.

On the left-hand side of FIG. 1, the cylinder housing 10 and thus the cylinder barrels 16 and 18 are in a heated state W, which is achieved, for example, during fired operation or after a certain period of time after fired operation has begun. FIG. 1 shows, in the center and on the right-hand side, a cylinder housing 20 according to a first embodiment in a cold state K and heated state W, respectively, the cylinder housing 20 being explained in more detail below.

The heated state W of the cylinder housing 10 shown on the left-hand side of FIG. 1 is achieved, for example, if no special measures are provided on the barrels 16 and 18 or if the barrels are the same in relation to the cold state thereof, in particular in terms of their honing and/or their diameter. In the cold state, the cylinder barrels 16 and 18 of the cylinder housing 10 which are shown on the left-hand side of FIG. 1 have, for example, at least substantially the same contours, in particular internal contours. Effects or boundary conditions, which will be explained in more detail below, may lead to different distortions of the cylinders 12 and 14 and thus of the cylinder barrels 16 and 18, these distortions also being referred to as cylinder distortions. The effects or boundary conditions mentioned above are, for example, combustion chamber pressures occurring in the cylinders 12 and 14 during fired operation, thermal expansions resulting from the cylinder housing 10 being heated as a result of fired operation and/or screw connections by means of which the cylinder housing 10 is connected to the cylinder head. These boundary conditions or effects may result in cylinder-specific, i.e., cylinder-individual, cylinder distortions such that the cylinders 12 and 14 or the cylinder barrels 16 and 18 and thus the internal contours of the cylinder barrels 16 and 18 may be distorted, i.e., deformed, differently proceeding from the cold state. As a result, the cylinder barrels 16 and 18 have different internal contours in the heated state W shown on the left-hand side of FIG. 1 such that the cylinders 12 and 14 have different shapes at the internal circumference.

These different, cylinder-specific cylinder distortions can lead to drawbacks in terms of the friction power and the noise characteristics of the reciprocating internal combustion engine, since they may result, for example, in unfavorable values for a clearance between each piston and the relevant cylinder barrel 16 or 18. This clearance is also referred to as piston clearance. If, for example, the cylinder-specific cylinder distortions result in an excessively high value for the piston clearance, this may result in undesired noises being generated, since, for example, contact alteration of the piston against the relevant cylinder barrel 16 or 18 can lead to noises. If, for example, the cylinder-specific cylinder distortions result in excessively low values for the piston clearance, this may result in overlapping states between the piston and the relevant cylinder barrel 16 or 18, for example. This results in the reciprocating internal combustion engine having excessively high friction power, and this may result in high fuel consumption and high $CO_2$ emissions.

From the cylinder housing 20 shown in FIG. 1, the function and purpose of which corresponds to the function and purpose of the cylinder housing 10, it can be seen that the cylinder barrels 16 and 18 and thus the cylinders 12 and 14 are different from one another in the cold state K in terms of their respective internal contours 22, 24 formed by the respective cylinder barrels 16, 18. According to the first embodiment, linear shape correction by means of trumpet honing is provided, the cylinder barrels 16 and 18 being different from one another in the cold state K in terms of their specific trumpet honing and/or in terms of their respective diameters.

FIG. 1 shows, on the right-hand side, the heated state W of the cylinder barrels 16 and 18 of the cylinder housing 20 which are shown in the center of FIG. 1, on which the above-mentioned special measures are provided, by special machining, in the form of the different trumpet honing and/or the different diameters. The heated state shown on the right-hand side of FIG. 1 results from the combination of the cylinder barrels 16 and 18 or the internal contours 22 and 24 shown on the left-hand side of and in the center of FIG. 1. It can be seen from FIG. 1 that, in the heated state W shown on the right-hand side, the cylinder barrels 16 and 18 or the internal contours 22 and 24 thereof are at least brought closer to a desired course 19 which indicates a target shape and thus a desired course or a desired shape for the relevant cylinder barrel 16 or 18. In particular, the course 19 indicates a desired trumpet shape which can be produced by the above-mentioned trumpet honing, optionally in combination with a cold clearance adjustment.

In other words: In order to optimize or compensate for the cylinder-specific cylinder distortions in the cylinder housing 20 and thus in order for it to be possible for the reciprocating internal combustion engine to be operated in a particularly efficient manner and for the reciprocating internal combustion engine to have particularly advantageous noise characteristics, in the cylinder housing 20, the cylinders 12 and 14 are different from one another, in particular in the cold state K, in terms of their respective internal contours 22 and 24 formed by the respective cylinder barrels 16 and 18. In other words, the cylinders 12 and 14 are different from one another at ambient temperature in terms of their respective internal contours 22 and 24 formed by the respective cylinder barrels 16 and 18, the shapes of the internal contours 22 and 24 becoming alike, for example, due to the respective cylinders 12 and 14 being heated as a result of fired operation.

In the first embodiment, as can be seen in the center of FIG. 1, the different, cylinder-specific cylinder distortions of zero order are linearly corrected. Each internal contour 22 and 24 widens downwards in an axial direction of the cylinder 12 and 14, respectively, in a specific portion. Therefore, each internal contour 22 and 24 widens in a direction in which the piston moves as it travels from the top dead center to the bottom dead center. Each internal contour 22 and 24 is produced, for example, by conical trumpet honing. As a result of the different internal contours 22 and 24, the internal contours 22 and 24 also differ from one another in terms of at least one particular internal diameter, the particular internal diameter can also be referred to as the cylinder diameter. As a result of using the cylinder-specific trumpet honing and the particular cylinder-specific diameter, an at least substantially optimum piston clearance can be set, such that excessive friction power and the generation of undesired noises can be prevented.

It can also be seen from FIG. 1 that, for example, each internal contour 22 and 24 widens downwards over the entire axial extension thereof. The cylinder housing 10 or 20 is supported against or connected to the cylinder head, at least indirectly, by means of a joint face 25, for example. In the first embodiment illustrated in FIG. 1, the widening of the internal contour 22 and 24 and thus the trumpet shape starts at the joint face 25. In the first embodiment, each internal contour 22 and 24 has an at least substantially linear course, as a result of which differences of zero order between the cylinder distortions can be corrected. As a result of a non-linear course of each internal contour 22 and 24 in the cold state K, differences of a higher order between the cylinder distortions can be corrected. Each internal contour 22 and 24 may widen downwards, this widening also beginning at the joint face 25 in the second embodiment.

Figure 2:
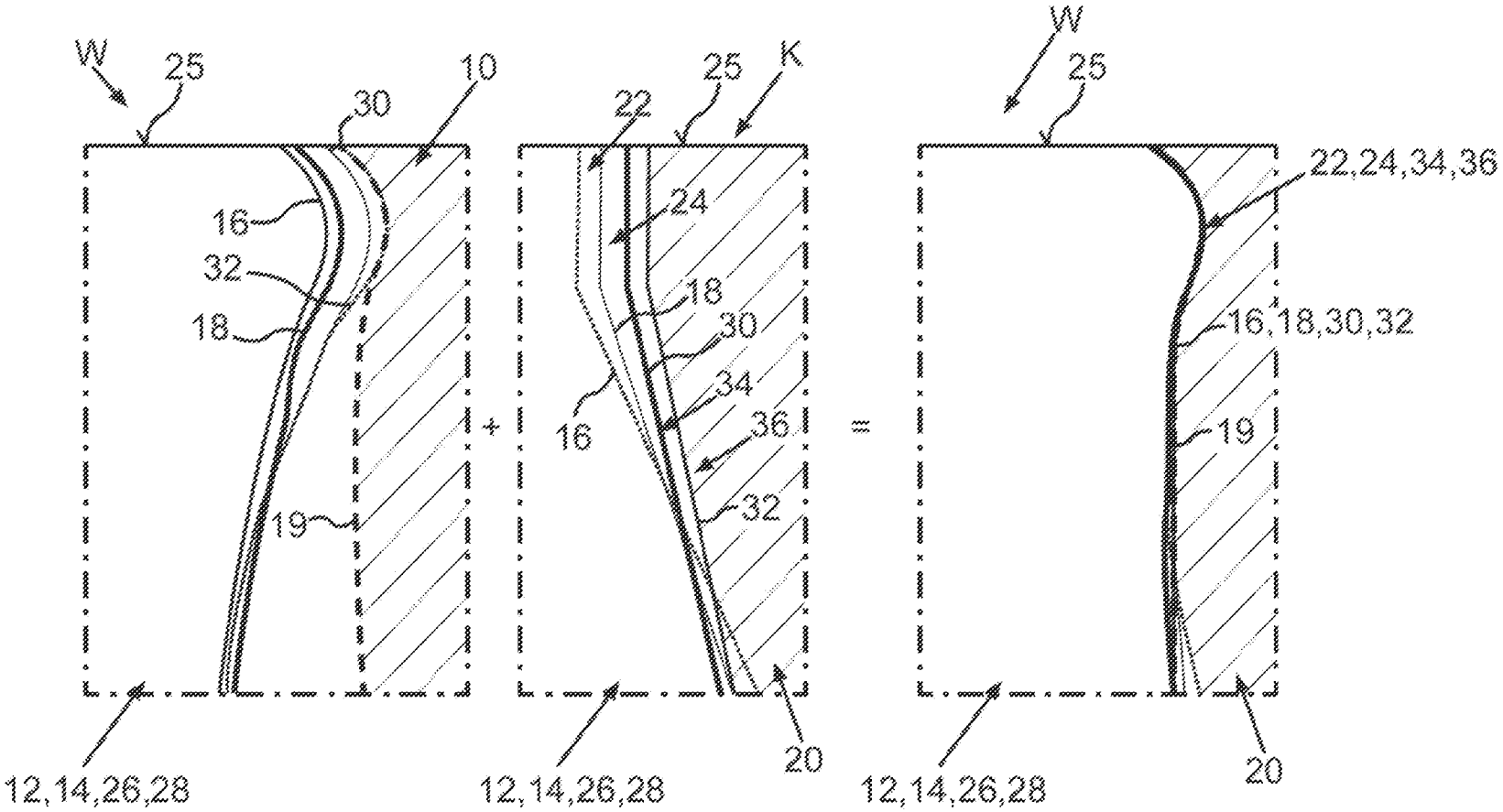
FIG. 2 shows details of a schematic side view of the cylinder housing according to a second embodiment.

FIG. 2 shows a second embodiment of the cylinder housing 20, with the cylinder housing 10 also being visible in FIG. 2. Here, the cylinder housing 10 or 20 comprises, for example, four cylinders 12, 14, 26 and 28. The cylinder 12 comprises the cylinder barrel 16, the cylinder 14 comprises the cylinder barrel 18, the cylinder 26 comprises a cylinder barrel 30, and the cylinder 28 comprises a cylinder barrel 32.

In order to compensate for the cylinder-specific distortions of the cylinders 12, 14, 26 and 28, as in the second and third embodiments, in the cylinder housing 20, the cylinders 12, 14, 26 and 28 are different from one another in terms of their respective internal contours 22, 24, 34 and 36 formed by the respective cylinder barrels 16, 18, 30 and 32. FIG. 2 shows the cylinder housing 10 and 20 in the heated state denoted by reference sign W in FIG. 2, with FIG. 2 also showing the cylinder housing 20 in the cold state denoted by reference sign K.

In the cylinder housing 20, radial widening in combination with linear trumpet honing is provided in the cold state K such that each internal contour 22, 24, 34 and 36 widens downwards at least substantially linearly. As a result of the contours being radially widened to different extents, the differences of zero order in the individual distortions in the cylinder housing 10 or 20 can be corrected. The widening produced by the cylinder-specific trumpet honing begins below the joint face 25.

From FIG. 2, it can be seen that the internal contours 22, 24, 34 and 36 become alike as a result of the cylinders 12, 14, 26 and 28 being heated by fired operation of the reciprocating internal combustion engine, such that, in the heated state W, the internal contours 22, 24, 34 and 36 are very similar or are at least substantially the same or identical. The internal contours 22, 24, 34 and 36 correspond at least substantially to the desired target shape indicated by the course 19 or resemble the target shape to a particularly high extent.

Figure 3:
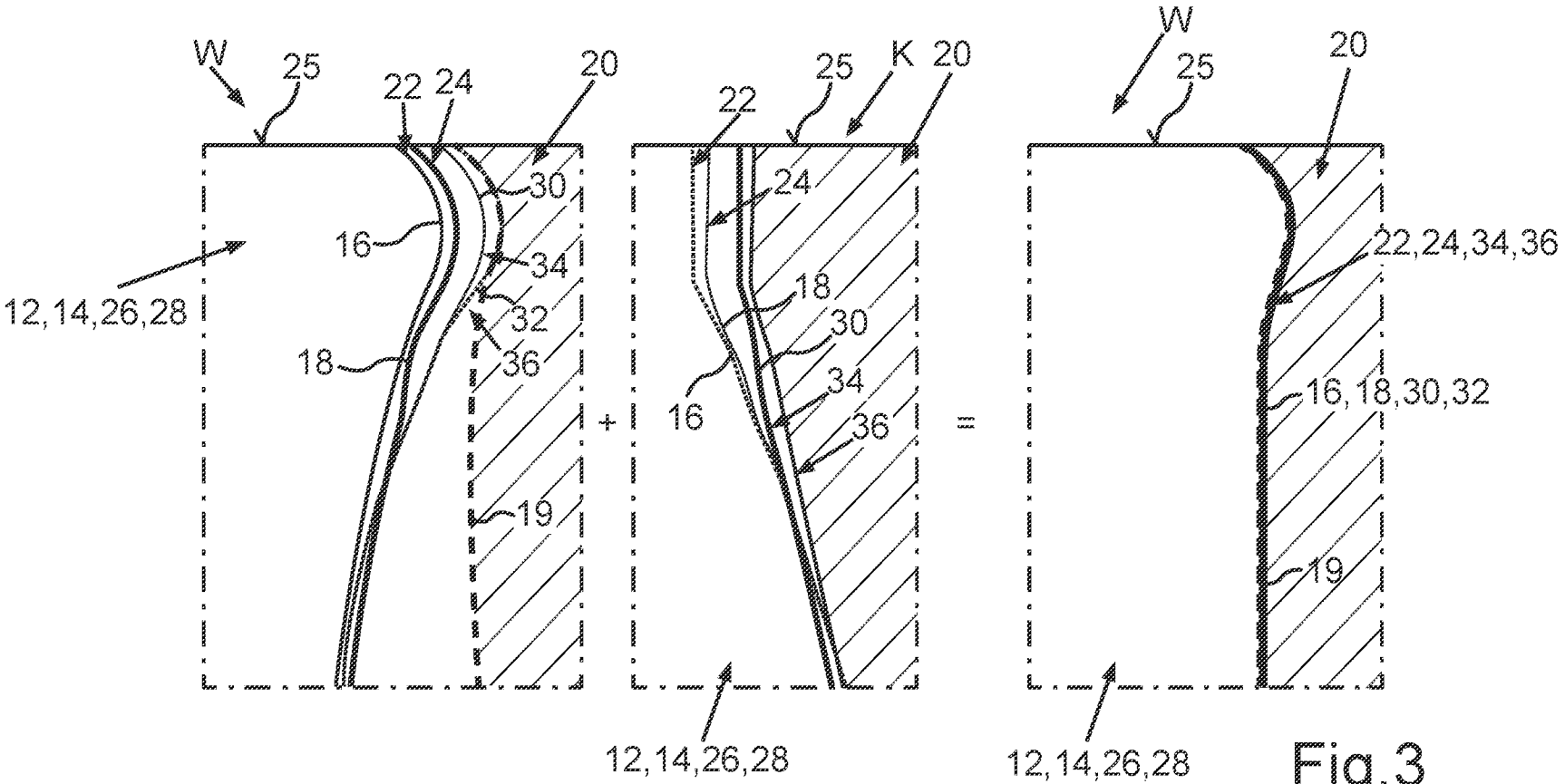
FIG. 3 shows details of a schematic side view of the cylinder housing according to a third embodiment.

FIG. 3 shows the cylinder housing 20 according to a third embodiment, with FIG. 3 showing the cylinder housing 10 and 20 in the heated state W and the cylinder housing 20 in the cold state K. In the fourth embodiment too, the internal contours 22, 24, 34 and 36 widen downwards, this widening beginning below the joint face 25. Each internal contour 22, 24, 34 and 36, as in the second embodiment, has a non-linear course in order to correct differences of higher orders.

The heated state W of the cylinder housing 10 shown in FIGS. 2 and 3 illustrates the cylinder-specific cylinder distortions of the cylinders 12, 14, 36 and 38 which can be compensated for by the described design of the internal contours 22, 24, 34 and 36 of the cylinder housing 20. Therefore, the heating of the cylinder housing 20 in the heated state W proceeding from the cold state K of the cylinder housing 20 and the cylinder-specific cylinder distortions resulting from this heating lead to the internal contours 22 and 24, 34 and 36 corresponding to the desired target shape indicated by the course 19 in the heated state W.

The invention claimed is:

1. A cylinder housing of a reciprocating internal combustion engine, comprising:

a first cylinder delimited by a first cylinder barrel; and a second cylinder delimited by a second cylinder barrel;

wherein the first cylinder has a first internal contour formed by the first cylinder barrel and the second cylinder has a second internal contour formed by the second cylinder barrel;

wherein the first internal contour is configured to differ from the second internal contour in a cold state of the reciprocating internal combustion engine such that a shape of the first internal contour and a shape of the second internal contour differ from each other and differ from a desired target shape in terms of a respective diameter and/or a respective honing shape of the respective cylinder barrels in the cold state of the reciprocating internal combustion engine, and such that in a fired operation of the reciprocating internal combustion engine the shape of the first internal contour and the shape of the second internal contour correspond to the desired target shape.

* * * * *